US009388816B2

(12) United States Patent
Sakaguchi et al.

(10) Patent No.: US 9,388,816 B2
(45) Date of Patent: Jul. 12, 2016

(54) TURBO-MOLECULAR PUMP

(75) Inventors: Yoshiyuki Sakaguchi, Urayasu (JP); Tooru Miwata, Funabashi (JP); Akihiko Wada, Funabashi (JP)

(73) Assignee: Edwards Japan Limited, Chiba (JP)

( * ) Notice: Subject to any disclaimer, the term of this patent is extended or adjusted under 35 U.S.C. 154(b) by 655 days.

(21) Appl. No.: 13/817,473

(22) PCT Filed: Jul. 20, 2011

(86) PCT No.: PCT/JP2011/066471

§ 371 (c)(1),
(2), (4) Date: Feb. 18, 2013

(87) PCT Pub. No.: WO2012/032863

PCT Pub. Date: Mar. 15, 2012

(65) Prior Publication Data

US 2013/0149105 A1 Jun. 13, 2013

(30) Foreign Application Priority Data

Sep. 6, 2010 (JP) ..... 2010-198797

(51) Int. Cl.
*F04D 19/04* (2006.01)
*F04D 29/64* (2006.01)

(52) U.S. Cl.
CPC ..... *F04D 19/042* (2013.01); *F04D 19/044* (2013.01); *F04D 29/644* (2013.01)

(58) Field of Classification Search
CPC ... F04D 19/042; F04D 19/044; F04D 29/644; F04D 19/04
See application file for complete search history.

(56) References Cited

U.S. PATENT DOCUMENTS 6,752,588 B2 * 6/2004 Kawanishi ..... F04D 19/04 415/143
2003/0095861 A1 * 5/2003 Sakaguchi ..... F04D 19/04 415/90

FOREIGN PATENT DOCUMENTS

CN 1432738 A 7/2003
JP 63147989 6/1988

(Continued)

OTHER PUBLICATIONS

First Office Action dated Feb. 2, 2015 for corresponding Chinese Application No. 201180011499.0.
PCT International Search Report from corresponding PCT Application No. PCT/JP2011/066471, dated Oct. 11, 2011.

(Continued)

*Primary Examiner* — Dwayne J White
*Assistant Examiner* — Julian Getachew
(74) *Attorney, Agent, or Firm* — Westman, Champlin & Koehler, P.A.

(57) ABSTRACT

An object of the present invention is to enhance the capacity of a turbomolecular pump.
A turbomolecular pump is a composite-type vacuum pump that combines a blade portion and a thread groove portion. Openings are formed at a joint portion between a rotor blade holding portion that holds rotor blades and a stepped portion that holds a rotor cylinder portion, such that the openings span both the rotor blade holding portion and the stepped portion. Part of the gas that is evacuated by the blade portions is evacuated by a thread groove portion that is formed of the rotor cylinder portion and a stator thread groove, and the rest of the gas is led into the rotor cylinder portion via the openings, and is evacuated by a thread groove portion that is formed of the rotor cylinder portion and another stator thread groove. Stress derived from rotation of a rotor can be withstood when the openings are formed at the joint portion between the rotor blade holding portion and the stepped portion. Moreover, a groove in which a balancer weight is disposed is provided at a clearance portion that lies further on the inlet port side of the other stator thread groove, thereby eliminating the necessity of shortening the length of the other stator thread groove.

5 Claims, 4 Drawing Sheets

(56) References Cited

FOREIGN PATENT DOCUMENTS

| | | | |
|---|---|---|---|
| JP | 046593 | | 1/1992 |
| JP | 0538389 | | 5/1993 |
| JP | H10122179 | A | 5/1998 |
| JP | 2000009087 | A | 1/2000 |

OTHER PUBLICATIONS

PCT Written Opinion from corresponding PCT Application No. PCT/JP2011/066471, dated Oct. 11, 2011.
Second Office Action dated Oct. 19, 2015 for corresponding Chinese Application No. 201180011499.0.

* cited by examiner (a)

(b)

(a)

(b)

TURBO-MOLECULAR PUMP

BACKGROUND OF THE INVENTION

1. Field of the Invention

The present invention relates to a turbomolecular pump that generates vacuum in a vacuum chamber or the like.

2. Description of the Related Art

Conventionally, the manufacture of IC products and the like involves performing each process in a respective operation chamber, such that once a process is over in one operation chamber, the product being processed is transferred to a subsequent operation chamber. Turbomolecular pumps have come to be used herein when, for instance, vacuum must be created in the interior of one such operation chamber (vacuum chamber).

For example, a composite-type turbomolecular pump such as the one illustrated in FIG. 4 is one instance of such turbomolecular pumps. In the figure, a suction port portion 102 and a discharge port portion 103 are formed in a casing 101. A rotor 104 is housed in the casing 101. Rotor blades 105 that extend towards the inner peripheral wall face of the casing 101, and a cylindrical rotor cylinder portion 117 are formed in the rotor 104.

Stator blades 106 that correspond respectively to the rotor blades 105 are attached to the stator side. A stator thread groove 115*a* is attached to the rotor cylinder portion 117, on the outer side of the rotor cylinder portion 117, and a stator thread groove 115*b* is attached to the inner side of the rotor cylinder portion 117. An evacuation mechanism that relies thus on thread grooves is referred to as a Holweck-type mechanism.

The gas that is sucked through the suction port portion 102 is compressed as a result of the interaction between the rotor blades 105 and the stator blades 106 that rotate at high speed, is further compressed by the rotor cylinder portion 117 and the stator thread grooves 115*a*, 115*b*, and is discharged out of the discharge port portion 103.

An opening 151 is provided at a portion at which the rotor cylinder portion 117 projects in the radial direction of the rotating shaft, in order to lead gas towards a flow channel inside the rotor cylinder portion 117.

In this conventional example, thus, pumping capacity is enhanced through evacuation by using inner and outer Holweck portions of the rotor cylinder portion 117. A specific example of a turbomolecular pump of such type is disclosed in Japanese Unexamined Utility Model Application Publication No. H5-38389.

A groove 161 for arranging therein a resin for a balancer is formed at the inner lower portion of the rotor cylinder portion 117.

That is because the center of gravity of the rotor 104 is located at the top; accordingly, the balancer is disposed in the inner lower portion, at a site as distant as possible from the center of gravity, so as to significantly bring out the effect of the balancer.

SUMMARY OF THE INVENTION

Excessive stress is inevitably generated as a result of the high-speed rotation of the rotor 104.

The portion at which of the rotor 104 projects in the radial direction and at which the opening 151 is provided is ordinarily narrow, and it was difficult, from the viewpoint of design, to provide sufficiently large openings therein. It was likewise difficult to impart the opening 151 with a shape that is small and that, at the same time, relieves stress, for instance a shape of large radius.

This was problematic in that, as a result, it was difficult to lead the evacuation gas towards the inner stator thread groove 115*b* while relieving stress.

Therefore, it is an object of the present invention to provide a turbomolecular pump having enhanced pumping performance.

The invention set forth in claim 1 provides a turbomolecular pump that comprises a casing; an inner cylinder disposed in a center of the casing; a first cylinder portion formed on an inlet port side; rotor blades that are formed from the first cylinder portion towards an inner peripheral face of the casing; a rotor rotatably supported in the inner cylinder, and having a second cylinder portion formed at a lower end of the first cylinder portion and having a larger outer diameter than that of the first cylinder portion, and a stepped portion that joins the lower end of the first cylinder portion and an upper end of the second cylinder portion; stator blades fixed to the casing and formed corresponding to the rotor blades; a first thread groove portion formed between an outer side of the second cylinder portion and an inner side of the casing; and a second thread groove portion formed between an inner side of the second cylinder portion and the inner cylinder, wherein opening portions opened at both the first cylinder portion and the stepped portion are formed at a joint portion of the first cylinder portion and the stepped portion.

The invention set forth in claim 2 provides the turbomolecular pump set forth in claim 1, wherein the opening portions are provided equidistantly over the entire perimeter of the joint portion of the first cylinder portion and the stepped portion.

The invention set forth in claim 3 provides the turbomolecular pump set forth in claim 1 or claim 2, wherein corners of the opening portions have a rounded corner, and a radius of the round shape in the first cylinder portion is smaller than a radius of the round shape in the stepped portion.

The invention set forth in claim 4 provides the turbomolecular pump set forth in claim 1, claim 2 or claim 3, wherein a recess for mass addition is formed at a portion that lies on the inner side of the rotor and further on the inlet port side of the second thread groove portion.

The present invention allows increasing the capacity of a turbomolecular pump by improving the evacuation system of the turbomolecular pump.

DESCRIPTION OF THE PREFERRED EMBODIMENTS

(1) Gist of the Embodiment

Figure 1:
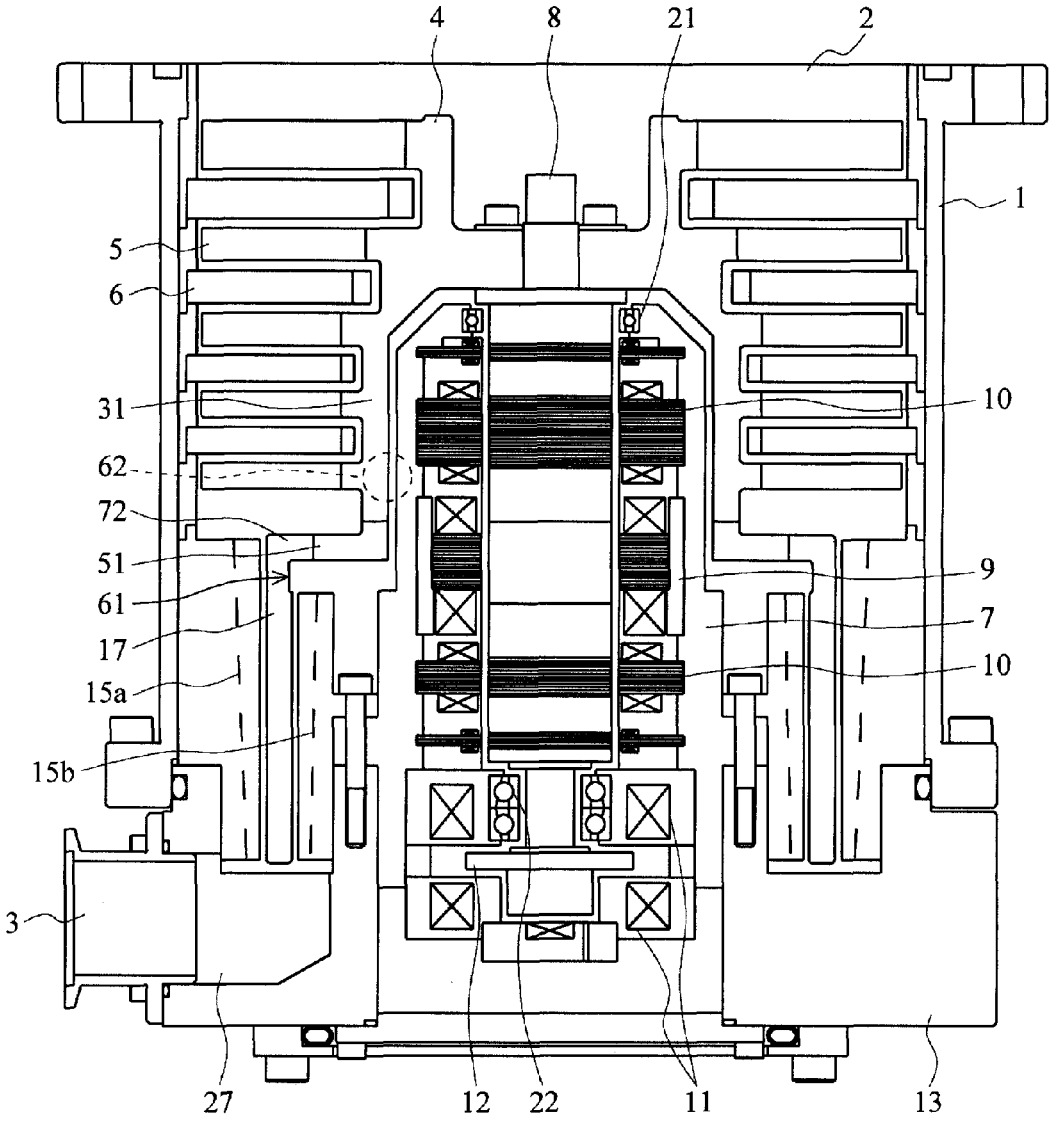
FIG. 1 is a diagram for explaining a turbomolecular pump in an embodiment.

A turbomolecular pump (FIG. 1) is a composite-type vacuum pump in which there are combined a blade portion and a thread groove portion. Openings 51 are formed at a joint portion between a rotor blade holding portion 31 that holds rotor blades 5 and a stepped portion 72 that holds a rotor cylinder portion 17, such that the openings 51 span the rotor blade holding portion 31 and the stepped portion 72.

Part of the gas that is evacuated by the blade portions is evacuated by a thread groove portion (outer Holweck portion) that is formed of the rotor cylinder portion 17 and a stator thread groove 15*a*; and the rest of the gas is led into the rotor cylinder portion 17 via the openings 51, and is evacuated by a thread groove portion (inner Holweck portion) that is formed of the rotor cylinder portion 17 and a stator thread groove 15*b*.

Stress derived from rotation of the rotor 4 can be withstood when the openings 51 are formed at the joint portion between the rotor blade holding portion 31 and the stepped portion 72.

Moreover, a groove 61 in which a balancer weight is disposed is provided at a clearance portion that lies further on the inlet port side of the stator thread groove 15*b*, thereby eliminating the necessity of shortening the length of the stator thread groove 15*b*.

The turbomolecular pump according to the present embodiment utilizes thus outer and inner Holweck portions, and hence the length of the stator thread groove 15*b* can be maximally increased. In turn, this allows enhancing compression performance without incurring increases in size of the turbomolecular pump.

(2) Details of the Embodiment

FIG. 1 is a diagram for explaining a turbomolecular pump of the present embodiment.

A casing 1 is overall substantially cylindrical. A suction port portion 2 (inlet port) that is connected to an opening portion (not shown) of an operation chamber, as a vacuum chamber, is formed at the top of the casing 1. A discharge port portion 3 (exhaust port) is formed at a base 13 at the bottom of the casing 1.

A rotor 4 is housed in the casing 1, in the axis line direction. The tubular rotor blade holding portion 31, and a plurality of rotor blades 5 that extend from the rotor blade holding portion 31 towards the inner wall face of the casing 1, are formed on the suction port portion 2 side of the rotor 4. The rotor blades 5 are formed in a plurality of stages in the axis line direction of the rotor 4.

On the inner wall face of the casing 1 there is formed a plurality of stator blades 6, similarly to the rotor blades 5, extending inward in the radial direction of the rotor 4, the stator blades 6 being disposed so as to overlap alternately with the rotor blades 5.

The lower portion of the rotor blades 5 projects in the radial direction, and the cylindrical rotor cylinder portion 17 is formed downward on the outer periphery of that projecting portion. Accordingly, the outer diameter of the rotor cylinder portion 17 is set to be greater than the outer diameter of the rotor blade holding portion 31.

A plurality of openings 51 is formed, at predetermined intervals in the circumferential direction, in the stepped portion 72 at which the rotor cylinder portion 17 projects. These openings 51 are explained in detail further on.

A groove 61, as a mass addition groove for arranging a resin-made balancer, is formed, in the circumferential direction, at the inner upper end portion of the rotor cylinder portion 17.

The groove 61 is formed in a clearance portion that is provided between the stator thread groove 15*b* and the inner upper end face of the rotor cylinder portion 17. Therefore, the evacuation path of the stator thread groove 15*b* is not shortened by the groove 61.

Thanks to the better technology of the control system of the rotor 4, the balancer can be thus provided closer to the center of gravity than in conventional cases.

A groove 62 may also be formed further up the inner side of the cylinder portion at which the rotor blades 5 are formed.

The groove 61 may be formed as a recess. The shape resulting from forming a recess over the circumference is a groove shape. A recess shape includes thus conceptually a groove shape.

A Holweck portion is formed thus in that a stator-side stator thread groove 15*a* is formed outside of the rotor cylinder portion 17, and a stator-side stator thread groove 15*b* is formed inside the rotor cylinder portion 17.

From among the gas that is compressed by the rotor blades 5 and the stator blades 6 and reaches the rotor cylinder portion 17, part of the gas is evacuated towards discharge port portion 3 via the flow channel (outer Holweck portion) between the rotor cylinder portion 17 and the stator thread groove 15*a*, and the rest is evacuated towards the discharge port portion 3 via the flow channel (inner Holweck portion) between the rotor cylinder portion 17 and the stator thread groove 15*b*, through the openings 51. That is, gas is evacuated efficiently via two routes.

In turbomolecular pumps it is important that the length of the evacuation path be set to be as large as possible. In the present embodiment there can be set an evacuation path inside and outside the rotor cylinder portion 17, and hence the size of the turbomolecular pump can be reduced in proportion.

In the present embodiment, the rotor side is shaped as a cylinder, and a thread groove is formed on the stator side, but the thread groove may be conversely formed on the rotor side, and the stator side be shaped then as a cylinder.

In that case, the thread groove is formed inside and outside the rotor cylinder portion 17, such that the portion corresponding to the stator thread groove 15*a* is the inner peripheral face of the cylinder, and the portion corresponding to the stator thread groove 15*b* is the outer peripheral face of the cylinder.

A rotor shaft 8 is disposed, at the axis line portion of the rotor 4, in such a manner that the rotor shaft 8 rotates integrally with the rotor 4.

Inward of the rotor 4 there are provided: a motor 9 that causes the rotor blades 5 and the rotor cylinder portion 17 to relatively rotate with respect to the stator blades 6 and the stator thread grooves 15*a*, 15*b*, through rotational driving the rotor shaft 8 at a high speed of about 20,000 to 90,000 rpm; radial direction electromagnets 10 that rotatably support the rotor shaft 8, in a contact-less manner, by causing the rotor shaft 8 to levitate magnetically in the radial direction; and axial direction electromagnets 11 that rotatably support the rotor shaft 8, in a contact-less manner, by causing the rotor shaft 8 to levitate magnetically in the axis line direction, via an armature disc 12.

A first and a second protective bearing 21, 22, which are respectively provided at the top and bottom ends of the rotor 4, rotatably support and protect the rotor shaft 8, by preventing direct contact between the rotor shaft 8 and the inner cylinder 7 and so forth in a case where the rotor shaft 8, rotating at high speed, should drop by failing to be properly supported rotationally by the electromagnets 10, 11.

The working of the turbomolecular pump according to the present embodiment is explained next.

To cause vacuum to be created in the operation chamber (vacuum chamber) by the turbomolecular pump, firstly the motor 9 is started up and the rotor 4 is rotationally driven, whereupon the rotor blades 5 and the rotor cylinder portion 17 are caused to rotate at high speed relative to the stator blades 6 and the stator thread grooves 15*a*, 15*b* that are stationary.

Upon relative rotation of the rotor blades 5 and the rotor cylinder portion 17 with respect to the stator blades 6 and the stator thread grooves 15*a*, 15*b*, thus, molecules of, for instance, water and the gas present in the operation chamber fly into the suction port portion 2; the molecules of gas, water and so forth pass along the rotor blade and stator blade group 5, 6; next, the molecules pass between the rotor cylinder portion 17 and the stator thread groove 15*a*; simultaneously therewith, some of the molecules flow into the rotor cylinder portion 17, through the openings 51, and pass between the rotor cylinder portion 17 and the stator thread groove 15*b*.

The molecules pass then through the discharge passage 27, and are discharged through the discharge port portion 3.

Herein, the flow rate of the molecules of gas, water and so forth is increased since the molecules are compressed by the stator thread groove 15*a* and are compressed also by the stator thread groove 15*b*.

As a result, the flow rate of molecules of gas, water and so forth is increased without incurring increases in size of the pump. This allows enhancing the performance of the pump.

Also, the opening surface area through which gas can pass can be made greater than that in a conventional thread groove portion, so that gas can be evacuated efficiently as a result.

Figure 2:
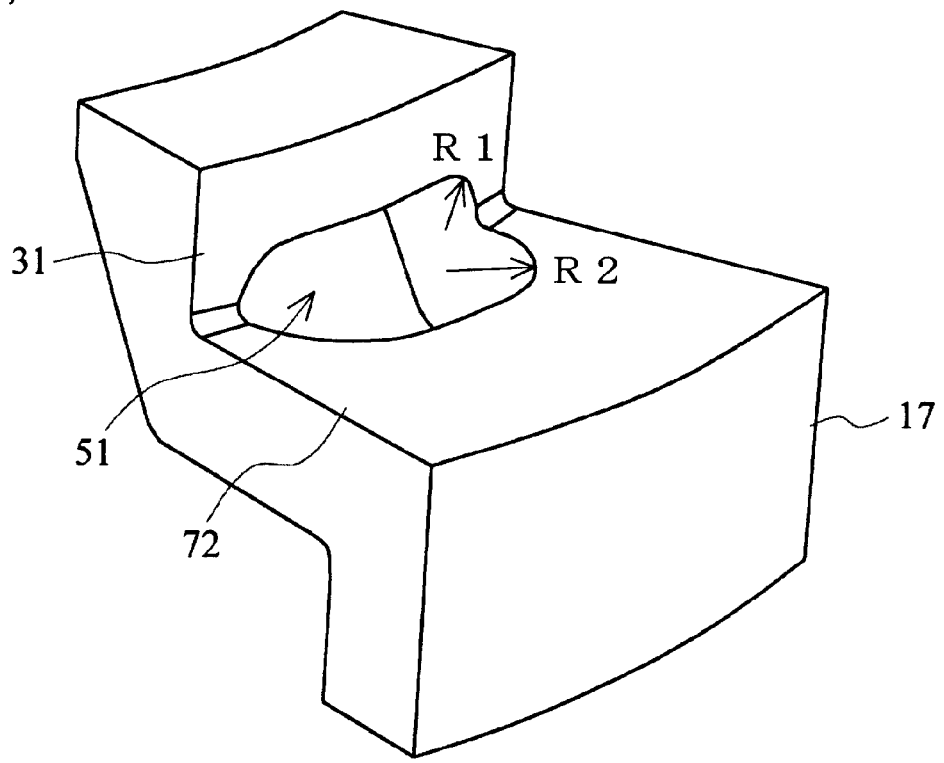
FIG. 2 is a diagram for explaining an opening portion.
Figure 2:
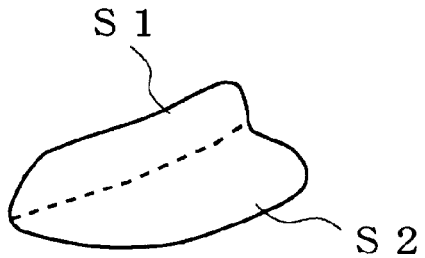

FIG. 2A is a diagram for explaining the openings 51.

The openings 51 are formed, to an elongated shape in the rotation direction of the rotor 4, towards the tubular rotor blade holding portion 31 that holds the rotor blades 5 (not shown in the figure) and towards the stepped portion 72 that projects in the radial direction, from the rotor blade holding portion 31, and that holds the rotor cylinder portion 17 at an outer peripheral portion.

A radius R1 formed at the corners with the rotor blade holding portion 31 and a radius R2 formed at the corners with the stepped portion 72 satisfy R1<R2.

The openings 51 having such a shape are formed through cutting with R1 and R2 end mills, from the inner side of the rotor 4.

It was found that stress on account of the rotation of the rotor 4 could be withstood through formation of the openings 51 thus at the joint portion between the rotor blade holding portion 31 and the stepped portion 72.

Originally, it was attempted to open the openings from the outside. However, the shape (of the openings 51) in the rotor cylinder portion 17 was strained when the openings were formed from the outside, and the effective stator thread groove 15*a* became shorter in proportion. Performance was difficult to be fully brought out as a result. By forming the openings from the inside, by contrast, it was possible to form the openings 51 having a sufficient opening surface area, commensurate with stress.

In order to withstand stress, it is important to impart a round shape to the corners of the openings 51. In particular, it was found that a greater stress-counteracting effect is elicited when R1<R2.

As illustrated in FIG. 2B, an opening surface area S of the openings 51 is the sum of an opening surface area S1 on the rotor blade holding portion 31 side and a opening surface area S2 on the stepped portion 72 side, and hence there can be set a large opening surface area S.

Figure 3:
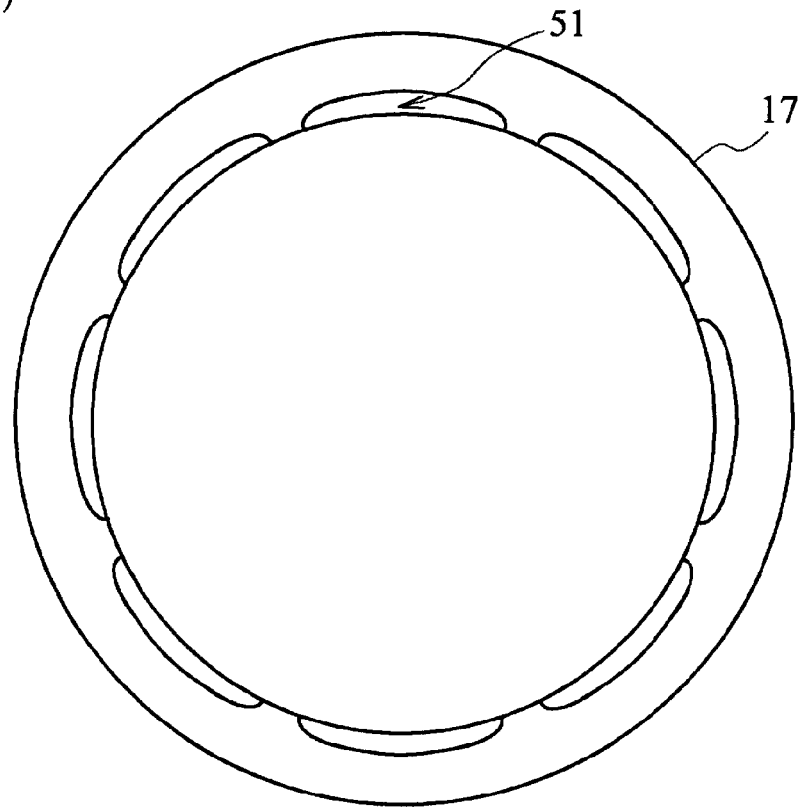
FIG. 3 is a diagram for explaining an opening portion and a thread groove portion.
Figure 3:
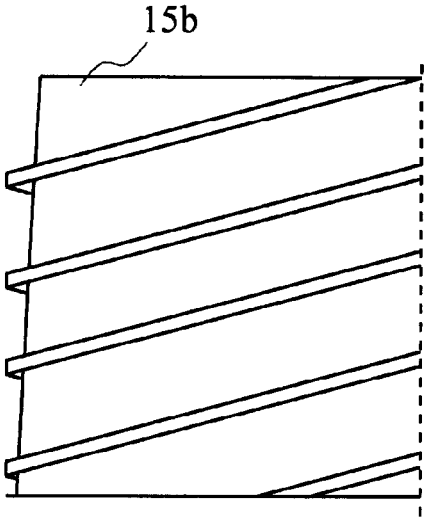
Figure 4:
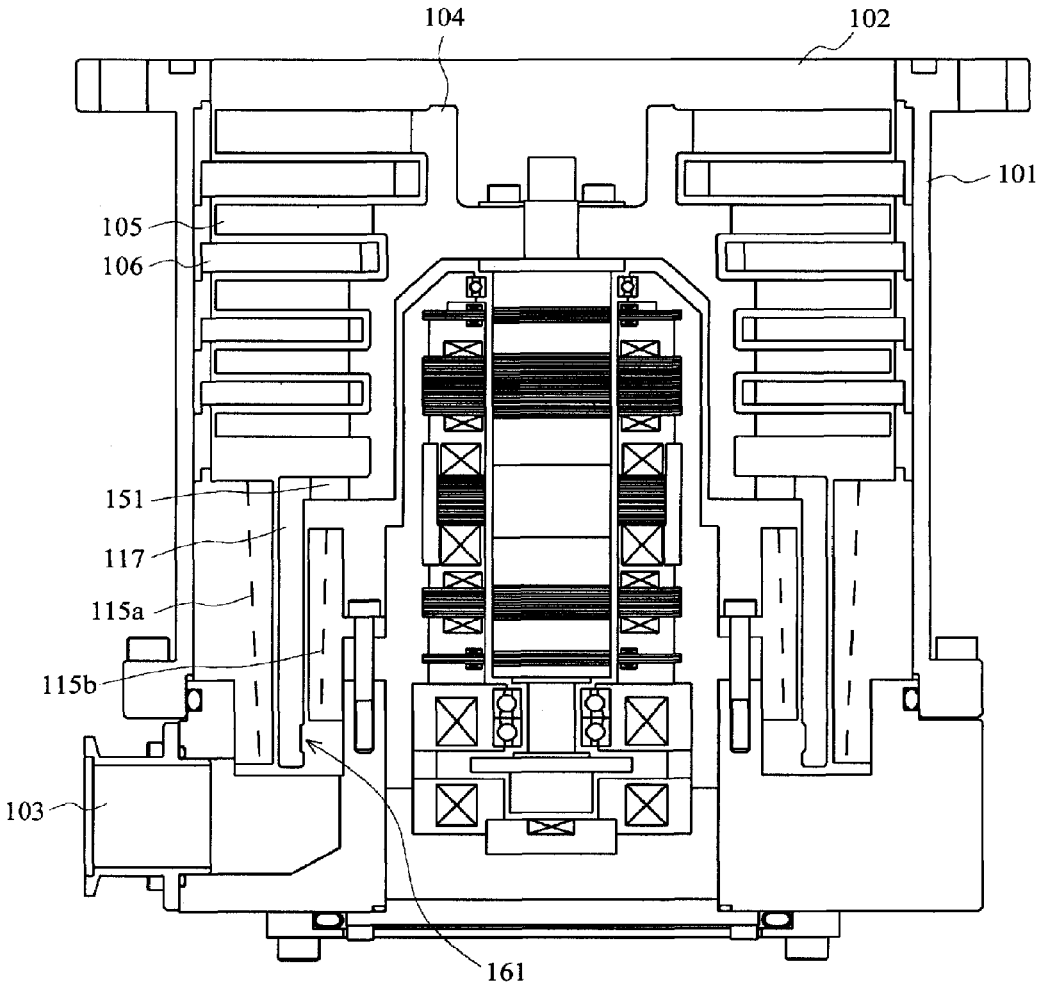
Fig.4 (PRIOR ART)
FIG. 4 is a diagram for explaining a conventional example.

FIG. 3A illustrates the openings 51 viewed from above.

In this example, there are formed eight openings 51 at 45° intervals. The inner-side spacing of the openings 51 is determined by the size of the turbomolecular pump, but ranges from about 2 to 4 mm in the case of small turbomolecular pumps.

FIG. 3B is a diagram illustrating the left half of the stator thread groove 15*b*.

Gas is discharged along the thread groove of the stator thread groove 15*b* upon rotation of the rotor cylinder portion 17.

In the turbomolecular pump of the present embodiment, thus, stress can be withstood, and openings 51 that can be provided are large enough to lead gas towards an inner Holweck portion. As a result, a dual flow channel can be secured in the form of the both inner and outer Holweck portions.

The compression performance of the Holweck portions can be thus enhanced, and the gas can be compressed and evacuated efficiently, through evacuation according to the dual parallel flow afforded by the inner and outer Holweck portions.

As a result, intake, compression and discharge efficiencies are increased, for a large flow rate and at a high back pressure. The performance of the turbomolecular pump is thus enhanced.

Also, using both inner and outer Holweck portions makes it possible to enhance the performance of a turbomolecular pump of identical size but that uses one Holweck portion.

Further, the Holweck portions can be made longer, and compression performance enhanced, by forming the groove 61 above the Holweck portions.

The embodiment explained above affords the features below.

The casing 1 and the inner cylinder 7 function respectively as a casing and as an inner cylinder that is disposed in the center of the casing.

The rotor blade holding portion 31 functions as a first cylinder portion that is formed on the inlet port side. The rotor blades 5 function as rotor blades that are formed from the first cylinder portion towards an inner peripheral face of the casing. The rotor cylinder portion 17 functions as a second cylinder portion, formed at a lower end of the first cylinder portion and having a larger outer diameter than that of the first cylinder portion. The stepped portion 72 functions as a stepped portion that joins the lower end of the first cylinder portion and an upper end of the second cylinder portion.

The rotor 4, which comprises the foregoing, is rotatably supported in the inner cylinder 7. Therefore, the rotor 4 functions as a rotor that is rotatably supported in the inner cylinder.

The stator blades 6 function as stator blades, fixed to the casing, and formed corresponding to the rotor blades.

The flow channel formed by the rotor cylinder portion 17 and the stator thread groove 15*a*, i.e. the outer Holweck portion, functions as a first thread groove portion formed between an outer side of the second cylinder portion and an inner side of the casing. The flow channel formed by the rotor cylinder portion 17 and the stator thread groove 15*b*, i.e. the inner Holweck portion, functions as a second thread groove portion formed between an inner side of the second cylinder portion and the inner cylinder.

The openings 51 are formed at a joining portion of the rotor blade holding portion 31 and the stepped portion 72 and are opened at the rotor blade holding portion 31 over a surface area S1 and are opened at the stepped portion 72 over a surface area S2. Accordingly, opening portions opened at both the first cylinder portion and the stepped portion are formed at a joint portion of the first cylinder portion and the stepped portion.

As illustrated in FIG. 3A, the openings 51 are provided as plurality of equidistant openings. Accordingly, the opening portions are provided equidistantly over the entire perimeter of the joint portion of the first cylinder portion and the stepped portion.

As illustrated in FIG. 2A, R1<R2. Accordingly, corners of the opening portions have a rounded corner, and a radius of the round shape in the first cylinder portion is smaller than a radius of the round shape in the stepped portion.

The groove 61 is formed at a portion further on the suction port portion 2 side of the stator thread groove 15*b*. Therefore, a recess for mass addition is formed at a portion that lies on the inner side of the rotor and further on the inlet port side of the second thread groove portion.

Focusing on the groove 61, there can be provided a turbomolecular pump that comprises a casing; an inner cylinder disposed in the center of the casing; a rotor rotatably supported in the inner cylinder, and having a first cylinder portion formed on an inlet port side, rotor blades that are formed from the first cylinder portion towards an inner peripheral face of the casing, a second cylinder portion formed at a lower end of the first cylinder portion and having a larger outer diameter than that of the first cylinder portion, and a stepped portion that joins the lower end of the first cylinder portion and an upper end of the second cylinder portion; stator blades fixed to the casing and formed corresponding to the rotor blades; a first thread groove portion formed between an outer side of the second cylinder portion and an inner side of the casing; and a second thread groove portion formed between an inner side of the second cylinder portion and the inner cylinder, wherein openings that communicate the first thread groove portion and the second thread groove portion are provided at the inlet port side of the first thread groove portion and the second thread groove portion of the rotor, and a recess for mass addition is formed at a portion that lies on the inner side of the rotor and further on the inlet port side of the second thread groove portion.

EXPLANATION OF REFERENCE NUMERALS

1 casing
2 suction port portion
3 discharge port portion
4 rotor
5 rotor blade
6 stator blade
7 inner cylinder
8 rotor shaft
9 motor
10 electromagnet
11 electromagnet
12 armature disc
13 base
15 stator thread groove
17 rotor cylinder portion
21 first protective bearing
22 second protective bearing
27 discharge passage
31 rotor blade holding portion
51 opening
61 groove
72 stepped portion
101 casing
102 suction port portion
103 discharge port portion
104 rotor
105 rotor blade
106 stator blade
115 stator thread groove
117 rotor cylinder portion
151 opening
161 groove

What is claimed is:

1. A turbomolecular pump, comprising:

a casing;

an inner cylinder disposed in a center of the casing;

a rotor rotatably supported in the inner cylinder, and having a first cylinder portion formed on an inlet port side, rotor blades that are formed from the first cylinder portion towards an inner peripheral face of the casing, a second cylinder portion formed at a lower end of the first cylinder portion and having a larger outer diameter than that of the first cylinder portion, and a stepped portion that joins the lower end of the first cylinder portion and an upper end of the second cylinder portion;

stator blades fixed to the casing and formed corresponding to the rotor blades;

a first thread groove portion formed between an outer side of the second cylinder portion and an inner side of the casing; and a second thread groove portion formed between an inner side of the second cylinder portion and the inner cylinder, wherein opening portions are formed at a joint portion of the first cylinder portion and the stepped portion, the opening portions are formed in both the first cylinder portion and the stepped portion.

2. The turbomolecular pump according to claim 1, wherein the opening portions are provided equidistantly from each other over an entire perimeter of the joint portion of the first cylinder portion and the stepped portion.

3. The turbomolecular pump according to claim 1 or 2, wherein the opening portions have corners in both the first cylinder portion and the stepped portion, and a radius of a round shape of the corners in the first cylinder portion is smaller than a radius of a round shape of the corners in the stepped portion.

4. The turbomolecular pump according to claim 1 or 2, wherein a recess for mass addition is formed at a portion that lies on an inner side of the rotor and further on an inlet port side of the second thread groove portion.

5. The turbomolecular pump according to claim 3, wherein a recess for mass addition is formed at a portion that lies on an inner side of the rotor and further on an inlet port side of the second thread groove portion.

* * * * *